US009289789B2

(12) United States Patent
Alluigi

(10) Patent No.: US 9,289,789 B2
(45) Date of Patent: Mar. 22, 2016

(54) TRIGGER DISPENSER DEVICE

(71) Applicant: GUALA DISPENSING S.p.A., Alessandria (IT)

(72) Inventor: Riccardo Alluigi, Alessandria (IT)

(73) Assignee: GUALA DISPENSING S.p.A., Spinetta Marengo, Alessandria (IT)

( * ) Notice: Subject to any disclaimer, the term of this patent is extended or adjusted under 35 U.S.C. 154(b) by 80 days.

(21) Appl. No.: 14/345,857

(22) PCT Filed: Sep. 28, 2012

(86) PCT No.: PCT/IB2012/055206
§ 371 (c)(1),
(2) Date: Mar. 19, 2014

(87) PCT Pub. No.: WO2013/080061
PCT Pub. Date: Jun. 6, 2013

(65) Prior Publication Data

US 2014/0224842 A1 Aug. 14, 2014

(30) Foreign Application Priority Data

Nov. 30, 2011 (IT) ..... BS2011A0167

(51) Int. Cl.
*B05B 11/00* (2006.01)
*B05B 15/00* (2006.01)

(52) U.S. Cl.
CPC ..... *B05B 11/3011* (2013.01); *B05B 11/0016* (2013.01); *B05B 11/3045* (2013.01); *B05B 11/3057* (2013.01); *B05B 15/005* (2013.01); *B05B 11/0037* (2013.01)

(58) Field of Classification Search
CPC ..... B05B 11/3011; B05B 11/0016; B05B 11/3045; B05B 11/3057; B05B 11/0037; B05B 11/0067; B05B 11/3069; B05B 15/005; B05B 15/066; G01F 11/028
See application file for complete search history.

(56) References Cited

U.S. PATENT DOCUMENTS

| | | | | |
|---|---|---|---|---|
| 5,244,126 | A * | 9/1993 | Geier | 222/383.1 |
| 5,730,335 | A | 3/1998 | Maas et al. | |
| 7,571,836 | B2 * | 8/2009 | Foster et al. | 222/340 |
| 7,938,299 | B2 * | 5/2011 | Fahy et al. | 222/382 |
| 8,870,033 | B2 * | 10/2014 | Alluigi et al. | 222/383.1 |
| 2008/0105713 | A1 | 5/2008 | Fahy et al. | |
| 2012/0234870 | A1 * | 9/2012 | Good et al. | 222/382 |

FOREIGN PATENT DOCUMENTS

| | | | |
|---|---|---|---|
| EP | 1 101 536 | A1 | 5/2001 |
| WO | WO 2012/035445 | A1 | 3/2012 |

OTHER PUBLICATIONS

International Search Report for corresponding International Patent Application No. PCT/IB2012/055206 mailed Dec. 20, 2012.

* cited by examiner

*Primary Examiner* — Nicholas J Weiss
(74) *Attorney, Agent, or Firm* — Merchant & Gould P.C.

(57) ABSTRACT

A trigger dispenser device (1) is for dispensing a liquid comprises a container (C) and a dispenser head (20). The head includes a frame (22) having a pressure chamber (24) and a secondary liquid aspiration duct (50), and an auxiliary body (2) attached to the frame (22). The auxiliary body is provided with a primary liquid aspiration duct (8) and an air aspiration chamber (4*b*). Between the frame (22) and the auxiliary body (2) a merger compartment (64) is formed and the air aspiration chamber (4*b*) surrounds the merger compartment (64) so as to seal it.

13 Claims, 4 Drawing Sheets

TRIGGER DISPENSER DEVICE

This application is a National Stage Application of PCT/1B2012/055206, filed 28 Sep. 2012, which claims benefit of Ser. No. BS2011A000167, filed 30 Nov. 2011 in Italy and which applications are incorporated herein by reference. To the extent appropriate, a claim of priority is made to each of the above disclosed applications.

BACKGROUND OF THE INVENTION

The present invention relates to a manually operated dispenser device of a liquid, generally trigger-operated.

Such dispenser devices, known in the jargon as "trigger pumps", are extremely widespread, with an annual production of several hundred million pieces. They are in fact widely used in the household cleaning, fabric treatment, hobby sectors etc.

For the production of such devices to be economically worthwhile, plants needs to be able to produce and assemble an elevated number of pieces. Consequently, even slight improvements to the production process of the components and the assembly process thereof, may entail a significant economic benefit.

In particular, it is essential for the device to be easy to assemble even when it has asymmetric or offset inner components.

All this must obviously marry with the increasingly restrictive requirements regarding the functionality of the devices, the reliability and the type of jet dispensed.

In particular, the need is felt for such devices to prevent the leakage of liquid, both because this leads to inconvenience during the transport of the devices, and because interpreted as a waste and negative quality by the user, especially in the case in which such liquid wets the hands.

SUMMARY OF THE INVENTION

The purpose of the present invention is to make a manually-operated dispenser device for liquids, in particular trigger-operated, which satisfies the aforesaid requirements and overcomes the drawbacks spoken of.

BRIEF DESCRIPTION OF THE DRAWINGS

The characteristics and advantages of the dispenser device according to the present invention will be evident from the following description, made by way of a non-limiting example, with reference to the attached drawings, wherein.

DETAILED DESCRIPTION OF THE PREFERRED EMBODIMENTS

Figure 1:
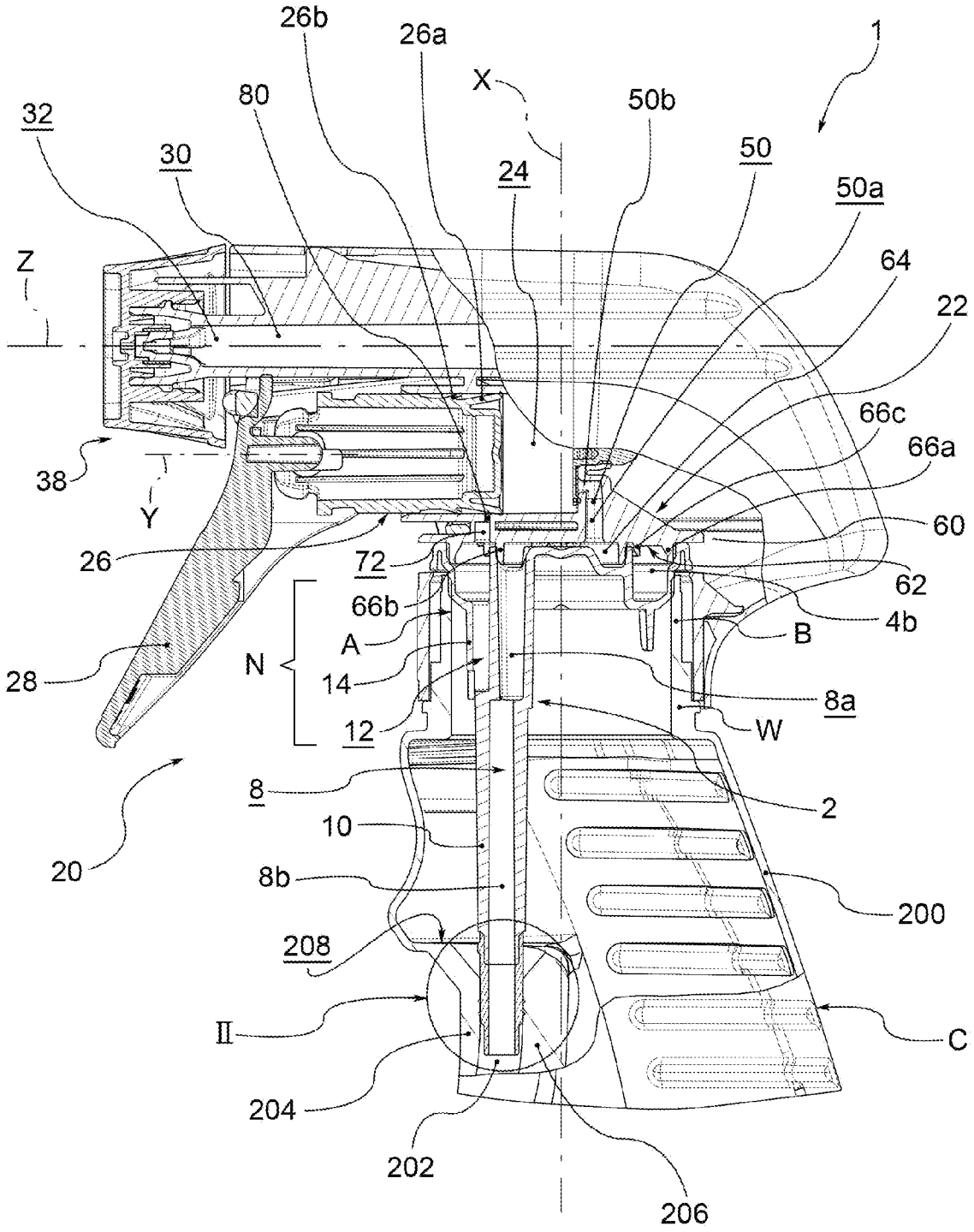
FIG. 1 shows a cross-section view of a dispenser device according to the present invention, according to one embodiment.
Figure 3:
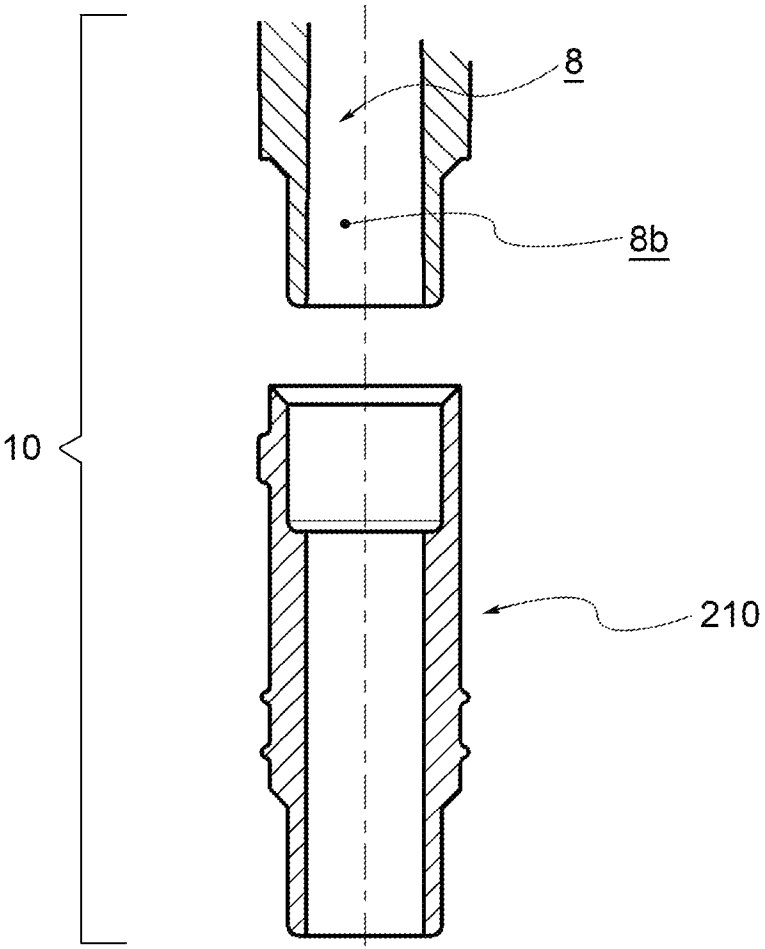
FIG. 3 shows the detail in FIG. 2, in separate parts.
Figure 2:
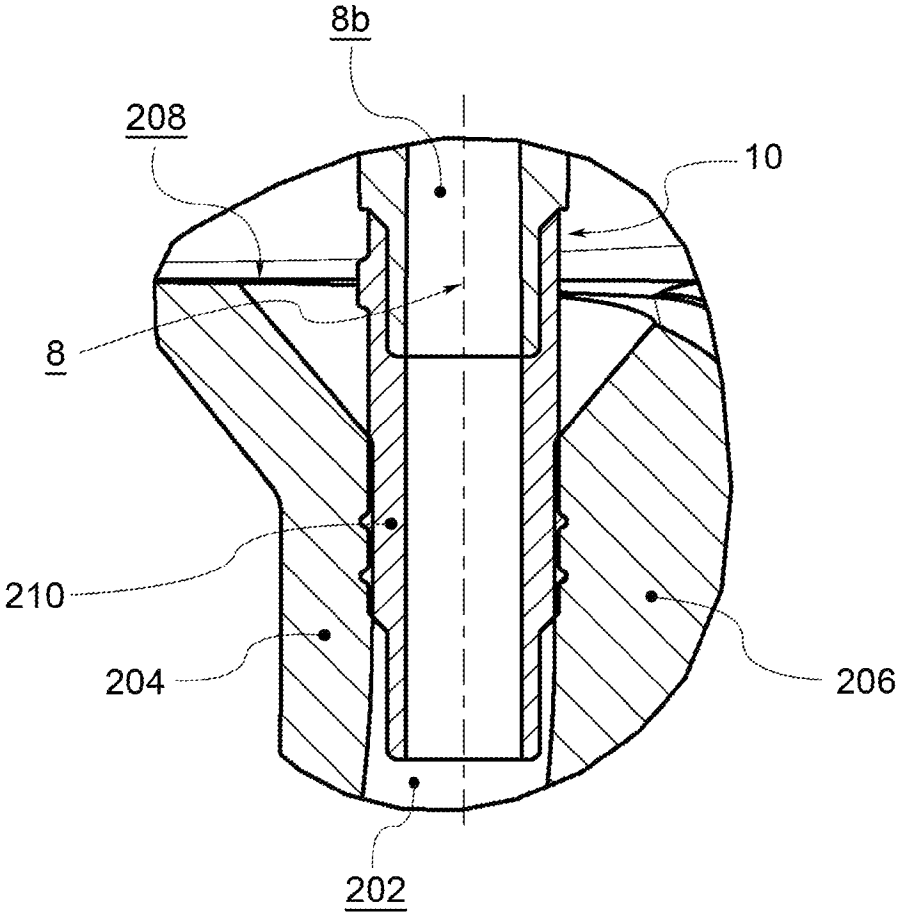
FIG. 2 shows an enlargement of the detail II in FIG. 1.
Figure 6:
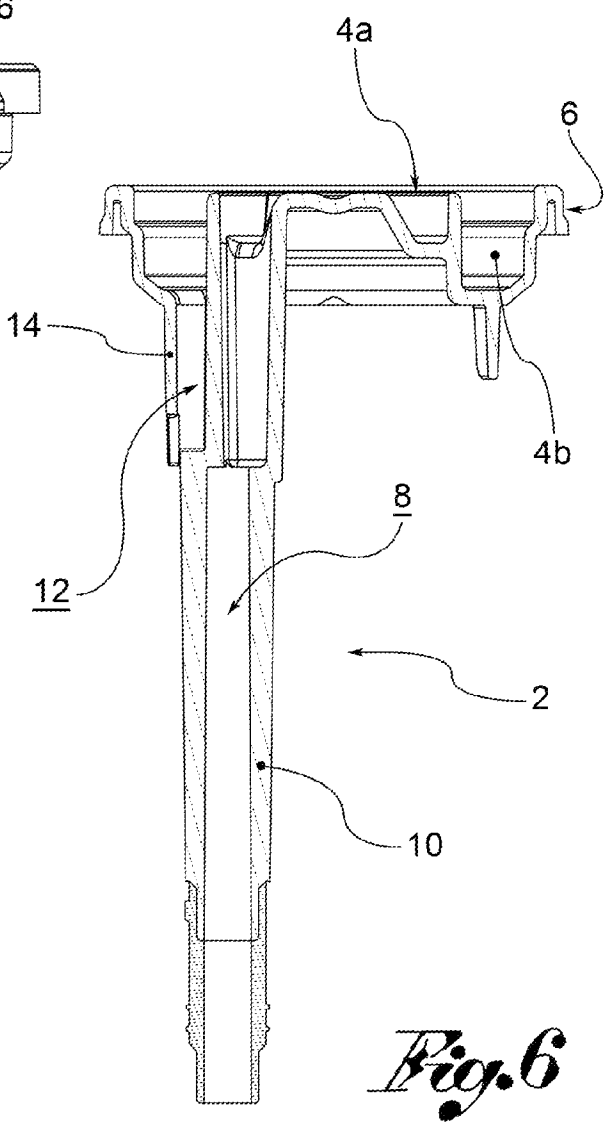
FIG. 6 shows a cross-section view of the auxiliary body in FIG. 5, according to the cross-section line VI in FIG. 5.
Figure 5:
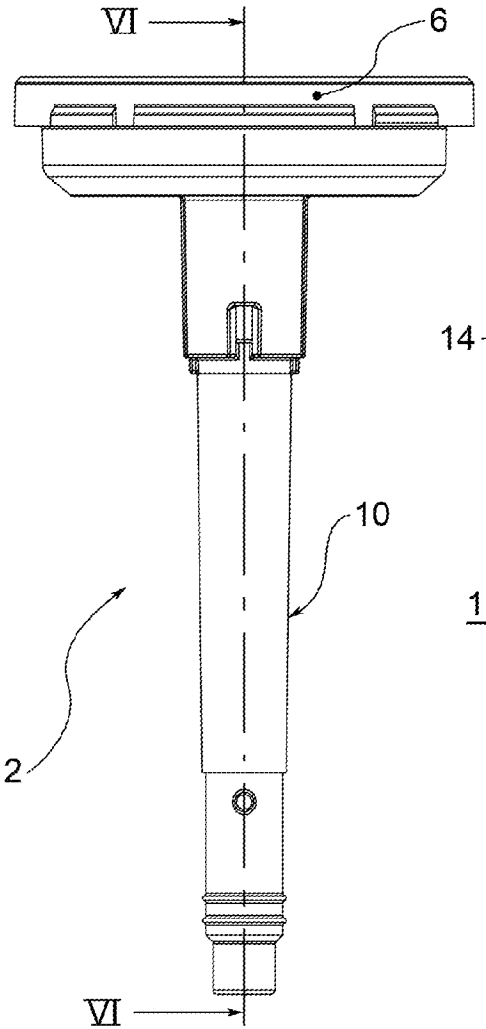
FIG. 5 shows a frontal view of the auxiliary body in FIG. 4.
Figure 4:
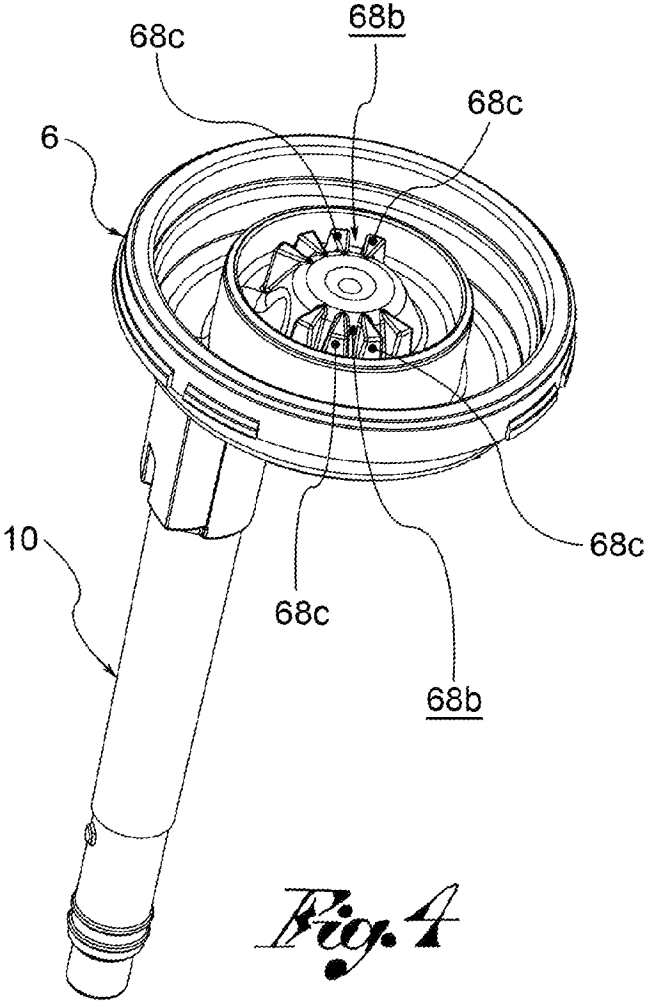
FIG. 4 shows an auxiliary body of the device in FIG. 1.
Figure 7:
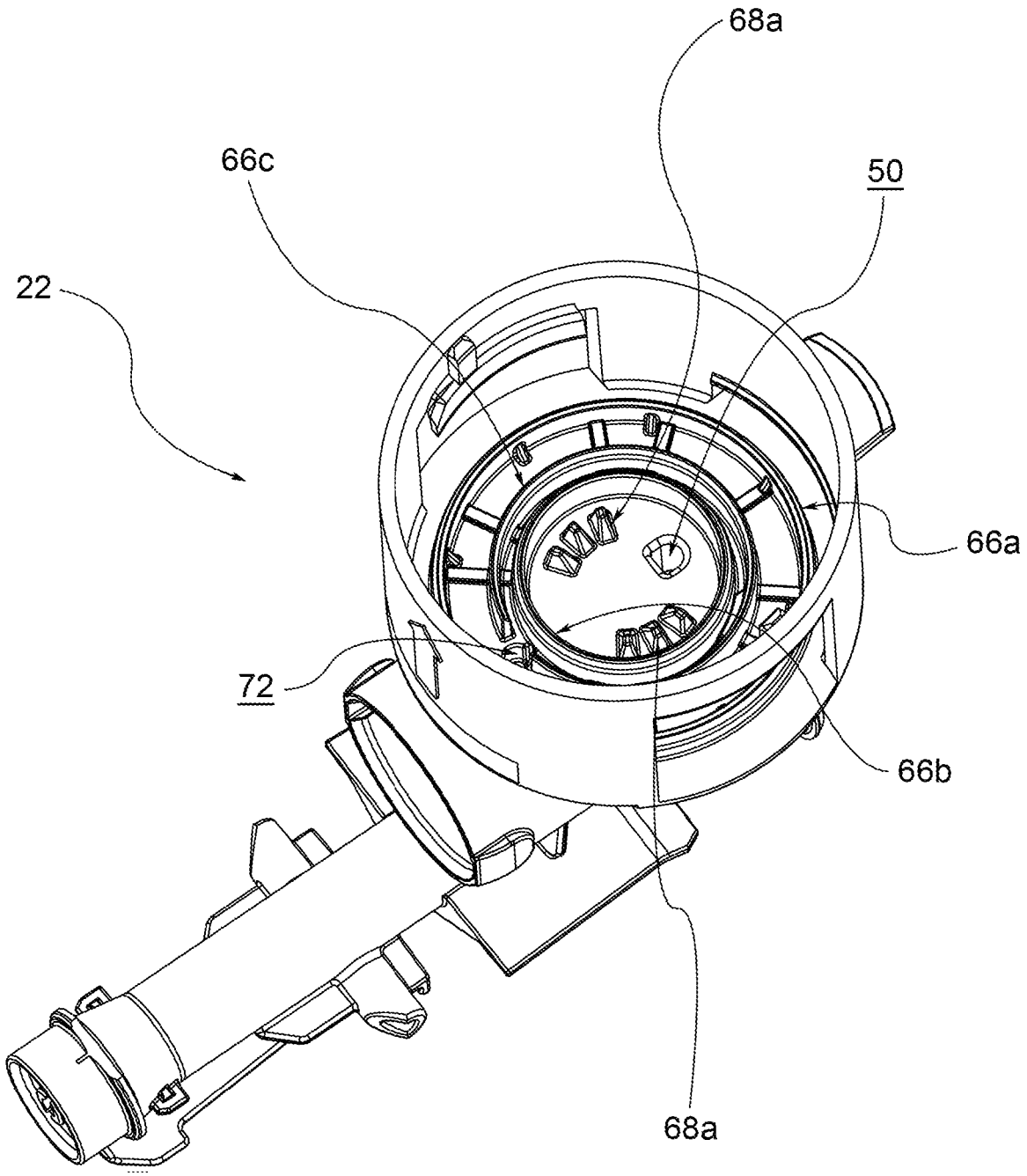
FIG. 7 shows a frame of the device in FIG. 1 from below.

With reference to the appended drawings, reference numeral 1 globally denotes a manually operated dispenser device of a liquid.

The dispenser device comprises a container C for containing the liquid to be dispensed, comprising a neck N made by a wall W annular around a container axis X, which defines by means of an annular rim B, a container aperture A for access to the inside thereof.

The dispenser device 1 comprises a dispenser head 20 attached to the container C to manually aspirate the liquid from the dispenser and dispense it to the outside.

The head 20 is pre-assembled and in general is sent for filling the container separately from it. After filling the container with liquid, the head is coupled to the container.

The head 20 further comprises an auxiliary body 2 attached to the neck N of the container C, at the aperture A thereof, to sealingly close it peripherally.

In particular, the auxiliary body 2 comprises a main portion 4, inserted through the aperture A in the neck N.

The main portion has an air aspiration chamber 4*b*, from which an annular collar 6 projects externally peripherally, superposed with the annular rim B of the neck N, for example facing so as to overlap said annular rim B.

In addition, the main portion 4 has a main surface 4*a*, in a substantially central position, surrounded peripherally by said air aspiration chamber 4*b*.

The auxiliary body 2 has a primary liquid aspiration duct 8, preferably eccentric to the container axis X, that is radially distanced from it.

The primary liquid aspiration duct 8 passes through the thickness of the main portion 4, placing the inner compartment of the container in communication with the main surface 4*a*.

In particular, preferably the primary liquid aspiration duct 8 is defined by means of a first tube 10.

For example, a flexible or rigid feed tube which extends as far as the bottom of the container to take up the liquid, can be connected to the tube 10.

In addition, the auxiliary body 2 has a primary air aspiration duct 12, radially distanced from the primary liquid aspiration duct 8, passing through the thickness of the main portion 4 to place the annular chamber 4*b* in communication with the compartment inside the container.

In particular, preferably the primary air aspiration duct 12 is defined by means of a second tube 14, radially distanced from the first tube 10.

Preferably the first tube 10 and the second tube 14 are made in one piece.

Preferably the auxiliary body, and in particular the main portion 4 thereof, is made by moulding in a single piece, in a flexible material.

In addition, the head 20 comprises a frame 22 for the support of the other components and for the realisation of several passages for the liquid. The auxiliary body 2 is attached to the frame 22.

The frame 22 has a pressure chamber 24, annularly defined by a chamber wall 25, extending along a pressure axis Y, preferably incident to the container axis X, for example orthogonally.

The head 20 comprises a piston 26, sealingly sliding in the pressure chamber 24 along the pressure axis Y, between a rest position, in which the volume of the pressure chamber 24 is maximum, and a limit dispensing position, in which the volume of the pressure chamber 24 is minimal, passing through intermediate dispensing positions.

Preferably the piston 26 comprises a head seal 26*b* and a tail seal 26*b*, distanced from the head seal along the pressure axis Y, for the seal between the piston and the chamber wall 25 which it slides in.

The head 20 further comprises manual actuation means suitable for manually moving the piston 26 in the pressure chamber 24.

Preferably the actuation means comprise a trigger 28, suitable for acting on the piston 26, for example anchored to it, and engaged with the frame 22, for example rotatably hinged to it or sliding in translation thereon.

Preferably in addition, the head 20 comprises elastic return means suitable for permanently pressing the piston 26 or the trigger 28 to return the piston 26 towards the rest position.

The frame 22 further presents a dispenser duct 30 extending along a dispensing axis Z, between a distal end 32, at the aperture towards the outside, and an opposite proximal end 34.

Preferably the pressure axis Y is parallel and distinct from the dispenser axis Z.

The head 20 further comprises, preferably, a nozzle 38, attached to the distal end 32 of the dispenser duct 30, to permit the dispensing of the liquid in the desired manner.

The pressure chamber 24 is suitable for being placed in communication with the dispenser duct 30.

In particular, the head 20 comprises valve dispenser means suitable for allowing the transit of the liquid from the pressure chamber 24 to the dispenser duct 30 when, during a dispensing step, the piston 26 moves from the rest position toward the limit dispensing position, and the liquid exceeds a predefined pressure threshold.

In addition, the frame 22 has a secondary liquid aspiration duct 50, which co-operates in the connection of the pressure chamber 24 to the compartment inside the container.

Preferably the secondary liquid aspiration duct 50 comprises an axial section 50*a*, extending parallel to the container axis X, and a radial section 50*b*, extending parallel to the pressure axis Y of the pressure chamber 24. Following the movement of the liquid aspirated by the container towards the pressure chamber, the axial section 50*a* is upstream of the radial section 50*b*.

Moreover, the head 20 comprises valve aspiration means suitable for permitting the transit of the liquid from the secondary aspiration duct 50 towards the pressure chamber 24 when, during a return step, the piston 26 moves toward the rest position from the limit dispensing position, and prevents the transit of the liquid from the pressure chamber 24 towards the secondary liquid aspiration duct 50 during said dispensing step.

In addition, the frame 22 comprises a support plate 60, by means of which the frame 22 engages with the auxiliary body 2.

The plate 60 has a functional surface 62 on the bottom, which the secondary liquid aspiration duct 50 comes out on, in a position radially distanced from the container axis X and partially offset from the primary liquid aspiration duct 8.

Preferably the secondary liquid aspiration duct 50, and in particular the axial section 50*a* thereof, is on the side opposite the secondary liquid aspiration duct 72 in relation to the container axis X.

Moreover, the frame 22 has a secondary air aspiration duct 72 which opens onto the functional surface 62 and which co-operates in the connection of the outside environment with the compartment inside the container.

Preferably the secondary air aspiration duct 72 is radially distanced from the secondary liquid aspiration duct 50.

When the auxiliary body 2 is attached to the frame 22, the functional surface 62 of the frame 22 is distanced from the main surface 4*a* of the auxiliary body 2, so that between these a merger compartment 64 is formed which connects the main liquid aspiration duct 8 of the auxiliary body 2 with the secondary liquid aspiration duct 50 of the frame 22.

The primary liquid aspiration duct 8, the merger compartment 64 and the secondary liquid aspiration duct 50 thereby form a liquid aspiration passage which places the compartment inside the container in communication with the pressure chamber 24 of the head 20.

In addition, preferably the frame 22 comprises an outer annular lip 66*a*, annularly complete, projecting in the direction of the container axis X from the functional surface 62 of the plate 60, inserted in the air aspiration chamber 4*b*, sealed with the rim thereof, to form a seal.

Moreover, preferably the frame 22 comprises an inner annular lip 66*b*, annularly complete, positioned radially inwards of the outer annular lip 66*a*, projecting in the direction of the container axis X from the functional surface 62 of the plate 60, coupled to the auxiliary body 2 to define the merger compartment 64 in a sealed manner.

Moreover, preferably, the frame 22 comprises a sealing reinforcement 66*c*, for example in the form of an incomplete annular element projecting from the functional surface 62 of the plate 60, in an outer radial position in relation to the inner annular lip 66*b*, in relation to which it operates as reinforcement for an improved seal with the auxiliary body 2.

Moreover, according to a preferred embodiment, the dispenser head 20 comprises reinforcement means provided on the frame 22 and counter reinforcement means provided on the auxiliary body 2, which reciprocally yieldingly engage to improve the resistance of the head to repeated separations from one container and applications to another, for example to attach the head to a refill container.

For example, the reinforcement means comprise at least one reinforcement protrusion 68*a*, projecting from the functional surface 62 of the plate 60, positioned inside the merger compartment 64, that is radially inwards of the inner lip 66*b*.

Preferably two groups of three protrusions 68*a* are provided, positioned symmetrically in relation to a centre of the functional surface 62.

Moreover, the counter means of reinforcement comprise at least one seat 68*b* made between protrusions 68*c* projecting axially from the auxiliary body 2 and in particular from the main portion 4*a* thereof.

The protrusions 68*a* of the frame, made in a more rigid material than the material of the protrusions 68*c* of the auxiliary body 2, are suitable for yieldingly inserting themselves with interference between the protrusions 68*c* of the auxiliary body.

The secondary air aspiration duct 72 comprises an aspiration hole 80 made through the chamber wall 25.

The primary air aspiration duct 12, the air aspiration chamber 4*b*, the secondary air aspiration duct and the aspiration hole 80 form an air aspiration passage.

Preferably when the piston 26 is in the rest position, the hole 80 is separated from the pressure chamber 24 by the head seal 26*a* of the piston 26 and is separated from the outside environment by the tail seal 26*b* of the piston 26; when the piston 26 is in the limit dispensing position, the hole 80 is in communication with the outside environment but is separated from the pressure chamber 24 by the tail seal 26*b* (and by the head seal 26*a*).

During normal functioning, in an initial rest configuration, the piston 26 is in the rest position, the dispenser valve means are closed, the aspiration valve means are closed, the air aspiration passage is closed towards the outside; the presence of liquid to be dispensed in the pressure chamber 24 is presumed.

In the case in which the dispenser device is positioned horizontally, part of the liquid contained in the container may pass into the air aspiration passage, and in particular, into the air aspiration chamber 4*b*. In such case, the outer lip 66*a* prevents the exit of the liquid towards the outside, acting as a static seal to the leakage of liquid.

In the dispensing step, the piston 26, by manual operation of the trigger 28, performs a dispensing stroke from the rest position towards the limit dispensing position.

By effect of the liquid in the pressure chamber 24, the liquid aspiration valve means remain closed, preventing the reflux of liquid towards the container.

By effect of the pressurised liquid, the valve dispenser means open, making the liquid transit from the pressure chamber 24 to the dispenser duct 30, thereby enabling dispensing from the nozzle 38.

When the trigger is released, the elastic return means move the piston 26 or trigger 28 from the limit dispensing position toward the rest position.

In the return step, the piston 26 performs a return stroke from the limit dispensing position towards the rest position.

The depression created in the pressure chamber 24 closes the dispenser valve means.

The depression created in the pressure chamber 24 opens the liquid aspiration valve means and the liquid transits from the compartment inside the container into the pressure chamber 24, through the primary liquid aspiration duct 8, the merger compartment 64 and the secondary liquid aspiration duct 50.

In such functioning step, the inner lip 66*b*, further strengthened by the reinforcement seal 66*c*, acts as a dynamic seal to the liquid, preventing it from flowing back towards the container.

At least for a part of the return step, the air aspiration passage is in communication with the outside environment, so that the air can be aspirated into the compartment inside the container.

The air aspiration passage, and in particular the secondary air aspiration duct 72, is fluidically separated from the liquid aspiration passage, and in particular from the merger compartment 64, so that there is no leakage of liquid.

In such functioning step, the outer lip 66*a* acts as a dynamic seal to prevent the exit of the aspirated air to the outside.

According to a further embodiment, the container C comprises a container wall 200 annular around the container axis X and an auxiliary liquid aspiration duct 202, made entirely in said lateral wall of the container C.

In other words, the container wall 200 comprises a portion of functional wall 204, for example positioned head on to the container, that is on the side intended for the exit of the liquid, and an auxiliary wall 206, in one piece with the container wall 200, inside the container C, which runs along the portion of functional wall 204, so as to form therewith the auxiliary liquid aspiration duct 202.

Said duct 202 is open near the bottom of the container, to aspirate the liquid contained therein.

Preferably said duct 202 extends from an engagement mouth 208 axially distanced from the neck N of the container C.

The primary liquid aspiration duct 8, at least partially eccentric to the container axis X, is suitable for being inserted in the engagement mouth 208 of the auxiliary liquid aspiration duct 202.

For example, advantageously, the primary liquid aspiration duct 8 comprises a first section 8*a*, which extends from the main surface 4*a*, having a first duct axis proximal to the container axis X, and a second section 8*b*, adjacent to the first section 8*a* and ending in the engagement mouth 208, distal to the container axis X.

Preferably in addition, the primary liquid aspiration duct 8 comprises, in the end portion suitable for inserting in the engagement mouth 208, a flexible coupling portion 210, made in material less rigid than the material of the remaining part of the primary liquid aspiration duct 8.

Preferably the flexible coupling portion 210 is made in one piece with the remaining part of the duct 8, for example by means of a co-moulding process.

For example, the flexible coupling portion 210 is made in Ethylene-Vinyl-Acetate (EVA) or in a material from the group of thermoplastic elastomers (TPE); the remaining part of the tube is rather preferably made in high density polyethylene (HDPE).

Advantageously, this makes the insertion of the duct 8 in the engagement mouth 208 particularly easy.

Preferably moreover, the primary liquid aspiration duct 8, and the secondary liquid aspiration duct 50 are positioned on diametrically opposite sides in relation to the container axis X. In particular, for example, the first section 8*a* of the primary liquid aspiration duct 8 is completely contained on one side of the container axis X and the axial section 50*a* of the secondary liquid aspiration duct 50 is completely contained on the other side.

Innovatively, the dispenser device according to the present invention, while having asymmetric components and offset ducts, remains simple to assemble and ensures an optimal seal to the leakage of liquid.

Such peculiar feature is among other things thanks to the reciprocal configuration of the air aspiration chamber and f the merger compartment, surrounded by said aspiration chamber.

In particular, according to a further advantageous aspect, the connection system of the head and container is particularly suitable for the case of containers with a liquid aspiration duct integral with the container, for which the integral duct is strongly offset from the aspiration duct of the frame and therefore requires an intermediate fluidic communication structure.

It is clear that a person skilled in the art may make modifications to the dispenser device described above so as to satisfy contingent requirements, all included within the sphere of protection defined by the following claims.

The invention claimed is:

1. A dispenser device for dispensing a liquid, comprising:

a container provided with a neck, suitable to contain the liquid to be dispensed, wherein the neck extends along a container axis, a dispenser head attached to the neck of the container, comprising:

a) a frame comprising;

i) a pressure chamber in which a piston sealingly slides along a pressure axis, and a dispenser duct, in fluidic communication with the pressure chamber, to dispense a liquid to the outside;

ii) a secondary liquid aspiration duct connectable to the pressure chamber;

b) a manual actuation device operatively connected to the piston to move the piston in the pressure chamber;

c) an auxiliary body attached to the frame comprising:

i) a primary liquid aspiration duct connected to a compartment inside the container;

ii) an air aspiration chamber connected to the compartment inside the container;

d) a reinforcement structure on the frame and a counter reinforcement structure on the auxiliary body configured for yielding reciprocal engagement;

a merger compartment between the frame and the auxiliary body, the merger compartment communicating upstream with the primary liquid aspiration duct and communicating downstream with the secondary liquid aspiration duct to form fluidic communication between the primary liquid aspiration duct and the secondary liquid aspiration duct; and wherein the air aspiration chamber at least partially surrounds the merger compartment and is sealingly separated from the merger compartment.

2. A dispenser device for dispensing a liquid, comprising:

a container provided with a neck, suitable to contain the liquid to be dispensed, wherein the neck extends along a container axis, a dispenser head attached to the neck of the container, comprising:

a) a frame comprising;

i) a pressure chamber in which a piston sealingly slides along a pressure axis, and a dispenser duct, in fluidic communication with the pressure chamber, to dispense a liquid to the outside;

ii) a secondary liquid aspiration duct connectable to the pressure chamber;

b) a manual actuation device operatively connected to the piston to move the piston in the pressure chamber;

c) an auxiliary body attached to the frame comprising:

i) a primary liquid aspiration duct connected to a compartment inside the container;

ii) an air aspiration chamber connected to the compartment inside the container;

d) a reinforcement structure on the frame and a counter reinforcement structure on the auxiliary body configured for yielding reciprocal engagement;

a merger compartment between the frame and the auxiliary body, the merger compartment communicating upstream with the primary liquid aspiration duct and communicating downstream with the secondary liquid aspiration duct to form fluidic communication between the primary liquid aspiration duct and the secondary liquid aspiration duct; and wherein the air aspiration chamber at least partially surrounds the merger compartment and is sealingly separated from the merger compartment; and wherein the reinforcement structure comprises at least one reinforcement protrusion positioned inside the merger compartment, that is radially inside an inner lip, and the counter reinforcement structure comprises at least one seat made between protrusions projecting axially from the auxiliary body.

3. Device according to claim 1, wherein the frame comprises an internal annular lip coupled to the auxiliary body to delimit in a sealed manner the merger compartment.

4. Device according to claim 1, wherein the frame comprises an external annular lip coupled to the auxiliary body to delimit in a sealed manner the air aspiration chamber.

5. Device according to claim 1, wherein a mouth of the secondary liquid aspiration duct in the merger compartment is at least partially offset from a mouth of the primary liquid aspiration duct in the merger compartment.

6. Device according to claim 1, wherein said container comprises an annular lateral wall in which an auxiliary liquid aspiration duct open near the bottom of the container is entirely made; and wherein the primary liquid aspiration duct is connectable to the auxiliary liquid aspiration duct of the container.

7. Device according to claim 6, wherein the container wall comprises a portion of functional wall and an auxiliary wall, in one piece with the container wall, inside the container, which runs along the portion of functional wall, so as to form with the functional wall the auxiliary liquid aspiration duct.

8. Device according to claim 6, wherein said auxiliary duct extends from an engagement mouth, axially distanced from the neck of the container.

9. Device according to claim 6, wherein the primary liquid aspiration duct comprises, in a terminal part suitable for connection with the auxiliary duct, a flexible coupling portion, made in material less rigid than material of a remaining part of the primary liquid aspiration duct.

10. Device according to claim 9, wherein the flexible coupling portion is made in one piece with the remaining part of the duct.

11. Device according to claim 6, wherein the primary liquid aspiration duct comprises a first section which extends from the main surface, having a first duct axis proximal to the container axis, and a second section, adjacent to the first section and ending in the auxiliary duct, distal to the container axis.

12. Device according to claim 1, comprising:

a diaphragm dispenser valve; and a diaphragm aspiration valve.

13. Device according to claim 1, wherein the actuation device comprises a translatable or rotatable trigger.

* * * * *